US006869312B2

(12) United States Patent
Hasebe

(10) Patent No.: US 6,869,312 B2
(45) Date of Patent: Mar. 22, 2005

(54) CONNECTOR IN WHICH A LOCKING PORTION TO BE ENGAGED WITH A HOUSING IS FORMED INSIDE A CONTACT

(75) Inventor: Kiyoharu Hasebe, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 10/798,563

(22) Filed: Mar. 12, 2004

(65) Prior Publication Data

US 2004/0180576 A1 Sep. 16, 2004

(30) Foreign Application Priority Data

Mar. 14, 2003 (JP) ..... 2003-070154

(51) Int. Cl.[7] ..... H01R 13/40
(52) U.S. Cl. ..... 439/595; 439/852
(58) Field of Search ..... 439/842, 843, 439/847, 851, 852, 856, 857, 748, 595

(56) References Cited

U.S. PATENT DOCUMENTS 5,558,547 A 9/1996 Breitschaft et al.
5,628,652 A * 5/1997 Ohsumi ..... 439/595
5,833,500 A * 11/1998 Mahon et al. ..... 439/852
5,860,836 A 1/1999 Ohno
5,897,405 A * 4/1999 Endo ..... 439/852
6,174,208 B1 * 1/2001 Chen ..... 439/852
6,375,501 B1 * 4/2002 Kojima ..... 439/595

FOREIGN PATENT DOCUMENTS

| | | |
|---|---|---|
| EP | 1271702 | 1/2003 |
| EP | 1289071 | 3/2003 |
| FR | 2721758 | 12/1995 |
| JP | 6215821 | 8/1994 |

OTHER PUBLICATIONS

European Search Reports Mailed Aug. 13, 2004.
"FCI Minaturise Son Sicma" Ingenieurs De L'Automobile, Raip. Boulogne, Fr, No. 702, 1996, page 18, XP000555838 ISSN: 0020–1200.

* cited by examiner

*Primary Examiner*—Tho D. Ta
(74) *Attorney, Agent, or Firm*—Baker Botts L.L.P.

(57) ABSTRACT

In a connector including a housing and a contact held in the housing for being brought into contact with a connection object, the contact includes a contacting portion surrounded by a wall portion to which a locking portion connected. The housing has a displaceable housing lance. The wall portion has first and second side walls faced to each other with a space left therebetween. The locking portion extends from the first wide wall towards the second side wall and has an extending end. The second side wall has a locking/holding portion holding the extending end. Thus, the locking portion is adapted to be engaged with the housing lance.

30 Claims, 9 Drawing Sheets

CONNECTOR IN WHICH A LOCKING PORTION TO BE ENGAGED WITH A HOUSING IS FORMED INSIDE A CONTACT

This application claims priority to prior Japanese application JP 2003-70154, the disclosure of which is incorporated herein by reference.

BACKGROUND OF THE INVENTION

This invention relates to a connector in which a contact is prevented from being released from a housing.

A connector of the type is disclosed, for example, in Japanese Patent Application Publication (JP-A) No. H06-215821. The connector comprises an insulating housing having a contact receiving portion and a contact held in the contact receiving portion. The contact is inserted into the contact receiving portion through one end of the housing. Herein, a direction along which the contact is inserted will be called an inserting direction while another direction opposite to the inserting direction will be called a removing direction.

In order to prevent the contact from being released from the housing, the housing is provided with an elastic arm while the contact is provided with a protruding portion protruding outward and engaged with the elastic arm in the removing direction. By engagement between the elastic arm and the protruding portion, the contact is steadily held in the contact receiving portion to be prevented from being released.

However, since the above-mentioned protruding portion protrudes outward, the size of the contact is increased and the contact is inhibited from being stably held in the housing. Further, when the contact is inserted into the contact receiving portion, the protruding portion may excessively deform the elastic arm to destroy the elastic arm. If the contact receiving portion is designed to be greater in size in order to prevent excessive deformation of the elastic arm, the connector is increased in size as a whole.

SUMMARY OF THE INVENTION

It is therefore an object of the present invention to provide a small-sized break-proof connector which is capable of increasing the strength of holding a contact.

Other objects of the present invention will become clear as the description proceeds.

According to one aspect of the present invention, there is provided a connector comprising a housing and a contact held in the housing, the housing having a displaceable housing lance, the contact having a contacting portion to be contacted with a connection object, a wall portion surrounding the contacting portion, and a locking portion connected to the wall portion and adapted to be engaged with the housing lance, the wall portion having first and second side walls faced to each other with a space left therebetween, the locking portion extending from the first wide wall towards the second side wall and having an extending end, the second side wall having a holding portion holding the extending end.

DESCRIPTION OF THE PREFERRED EMBODIMENTS

Figure 1:
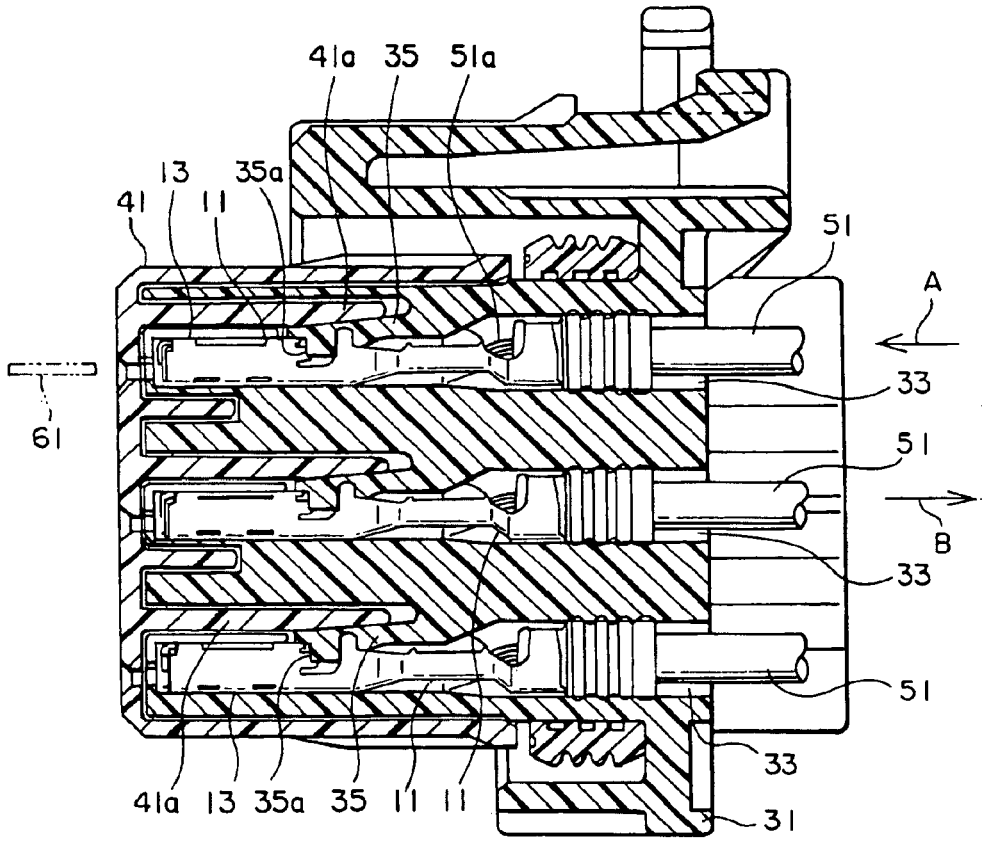
FIG. 1 is a sectional view of a connector according to a first embodiment of the present invention.

Referring to FIG. 1, description will be made of a connector according to a first embodiment of the present invention.

The connector illustrated in the figure comprises a plurality of conductive contacts 11 having a long size in an axial direction, an insulating housing 31 having a generally box-like shape and holding the contacts 11 at a predetermined space, and a key member 41 having a generally box-like shape and coupled to the housing 31. Each of the contacts 11 is connected to a cable 51.

Referring to FIGS. 2 to 7 in addition to FIG. 1, the contact 11 will be described. In FIGS. 2 through 7, the contact 11 not connected to the cable 51.

Each of the contacts 11 has a coupling portion 13 having a long size in the axial direction and formed into a cylindrical shape, a press-fit portion 17 connected to one end of the coupling portion 13 through a connecting portion 15, and a cable holding portion 19 connected to one end of the press-fit portion 17. The coupling portion 13, the connecting portion 15, the press-fit portion 17, and the cable holding portion 19 have a coupling bottom portion 21*a*, a connecting bottom portion 21*b*, a press-fit bottom portion 21*c*, and a holding bottom portion 21*d*, respectively, along a predetermined axial direction (which is transversal or horizontal direction in FIG. 1).

The coupling portion 13 has a first side wall or coupling wall portion 13*a* connected to one edge of the coupling bottom portion 21*a* and extending in one direction to be generally perpendicular to the coupling bottom portion 21*a*, and a second side wall or coupling wall portion 13*b* connected to the other edge of the coupling bottom portion 21*a* opposite to the one edge and extending in the one direction to be generally perpendicular to the coupling bottom portion 21*a*. Thus, the first and the second coupling wall portions 13*a* and 13*b* are faced to each other with a space left therebetween. The first coupling wall portion 13*a* is connected to a top wall or upper wall portion 13*d* extending from an upper edge of the first coupling wall portion 13*a* to an upper edge of the second coupling wall portion 13*b* to be generally perpendicular to the first and the second coupling wall portions 13*a* and 13*b*. Thus, the coupling portion 13 is formed into a rectangular cylindrical shape by the coupling bottom portion 21*a*, the first coupling wall portion 13*a*, the second coupling wall portion 13*b*, and the upper wall portion 13*d*.

The coupling portion 13 has a locking portion 13*e*. The locking portion 13*e* is connected to one edge of the first coupling wall portion 13*a* adjacent to the connecting portion 15 and extending in a direction perpendicular to the axial direction to be generally perpendicular to the first coupling wall portion 13*a*. The locking portion 13*e* is faced to one edge of the upper wall portion 13*d* on the side adjacent to the connecting portion 15. Therefore, a most part of an opening of the coupling portion 13 on the side adjacent to the connecting portion 15 is closed by the locking portion 13*e*. The locking portion 13*e* has an upper part located at a level substantially same as that of the upper wall portion 13*d* of the coupling portion 13.

The coupling portion 13 has an axial one end provided with a guide portion 13*g* extending from the upper wall portion 13*d* towards an opening of the coupling portion 13 on a front side to be generally perpendicular to the upper wall portion 13*d*. Inside the coupling portion 13, a connecting piece or connecting spring portion 13*k* bent from the upper wall portion 13*d* to face the upper wall portion 13*d* and connected to one end of a contacting base portion 13*j*, and an auxiliary piece or auxiliary spring portion 13*n* connected to the other end of the contacting base portion 13*j*. The auxiliary spring portion 13*n* has an end portion located between the contacting base portion 13*j* and an end portion of the contacting spring portion 13*k*. The contacting spring portion 13*k* is contacted with a conductive mating contact 61 of a mating connector illustrated in FIG. 1. A combination of the coupling bottom portion 21*a*, the first coupling wall portion 13*a*, the second coupling wall portion 13*b*, and the upper wall portion 13*d* forms a wall portion surrounding the contacting spring portion 13*k* and the auxiliary spring portion 13*n*.

Figure 7:
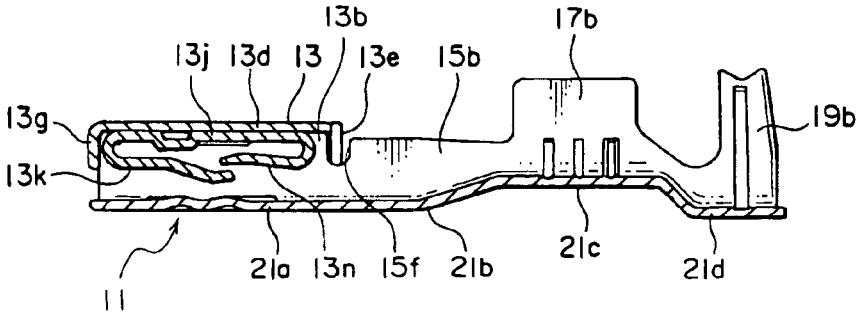
FIG. 7 is a sectional view taken along a line VII—VII in FIG. 4.
Figure 8:
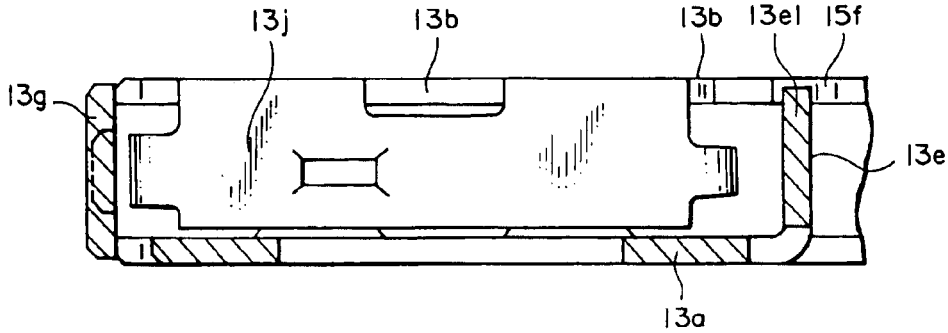
FIG. 8 is an enlarged sectional view taken along a line VIII—VIII in FIG. 2.
Figure 9:
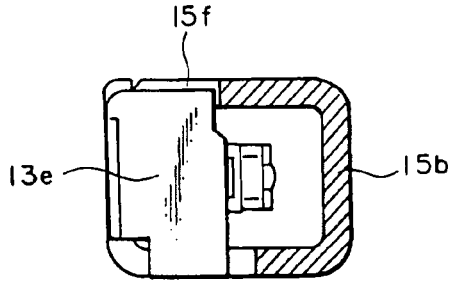
FIG. 9 is an enlarged sectional view taken along a line IX—IX in FIG. 4.
Figure 10:
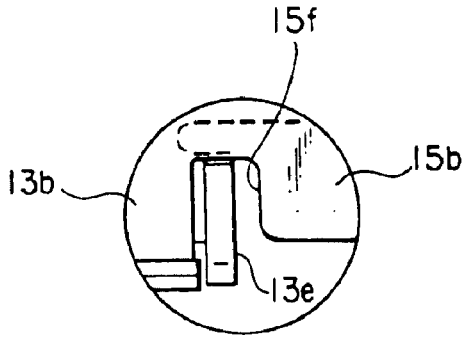
FIG. 10 is an enlarged front view of a locking/holding portion illustrated in FIG. 1.

The connecting portion 15 has a first connecting wall portion 15*a* connected to one edge of the connecting bottom portion 21*b* and extending in one direction to be generally perpendicular to the connecting bottom portion 21*b*, and a second connecting wall portion 15*b* connected to the other edge of the connecting bottom portion 21*b* opposite to the one edge and extending in the one direction to be generally perpendicular to the connecting bottom portion 21*b*. The first connecting wall portion 15*a* is connected to the first coupling wall portion 13*a*. The second connecting wall portion 15*b* is connected to the second coupling wall portion 13*b*. Between the second connecting wall portion 15*b* and the second coupling wall portion 13*b*, a cut-out portion or locking/holding portion 15*f* is formed to receive an end portion 13*e*1, namely, an extending end of the locking portion 13*e*, as illustrated in FIG. 10 (showing a part of FIG. 3 in an enlarged scale). As shown in FIG. 7, the locking/holding portion 15*f* has a groove-like cut-out shape formed by cutting an upper end of the wall part positioned between the second connecting wall portion 15*b* and the second coupling wall portion 13*b*.

The press-fit portion 17 has a first press-fit wall portion 17*a* connected to one edge of the press-fit bottom portion 21*c* and extending in one direction to be generally perpendicular to the press-fit bottom portion 21*c*, and a second press-fit wall portion 17*b* connected to the other edge of the press-fit bottom portion 21*c* opposite to the one edge and extending in the one direction to be generally perpendicular to the press-fit bottom portion 21*c*. The first press-fit wall portion 17*a* is connected to the first connecting-side wall portion 15*a*. The second press-fit wall portion 17*b* is connected to the second connecting wall portion 15*b*.

The cable holding portion 19 has a first holding wall portion 19*a* connected to one edge of the holding bottom portion 21*d* and extending in one direction to be generally perpendicular to the holding bottom portion 21*d*, and a second holding wall portion 19*b* connected to the other edge of the holding bottom portion 21*d* opposite to the one edge and extending in the one direction to be generally perpendicular to the holding bottom portion 21*d*. The first holding wall portion 19*a* is connected to the first press-fit wall portion 17*a*. The second holding wall portion 19*b* is connected to the second press-fit wall portion 17*b*.

Figure 11:
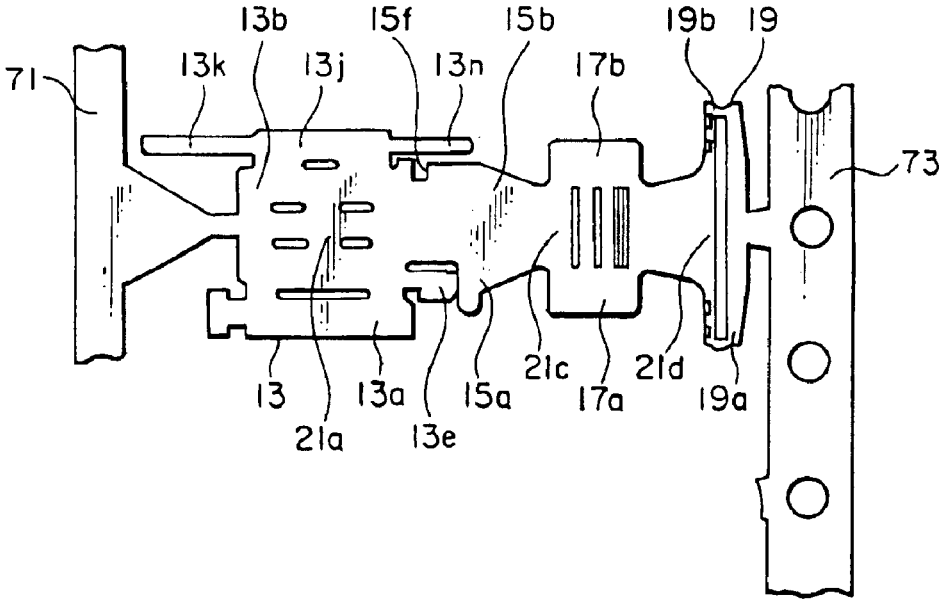
FIG. 11 is a plan view of the contact illustrated in FIG. 4 in a developed shape together with a carrier.

Referring to FIG. 11, description will be made of a method of producing the contact 11. In the figure, the contact 11 is shown in a developed shape. For convenience of illustration, like reference numerals are used.

Figure 2:
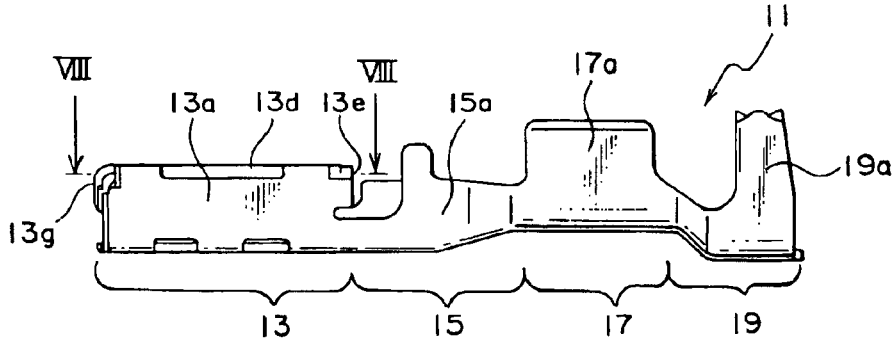
FIG. 2 is a front view showing a contact illustrated in FIG. 1 before a cable is connected thereto.
Figure 3:
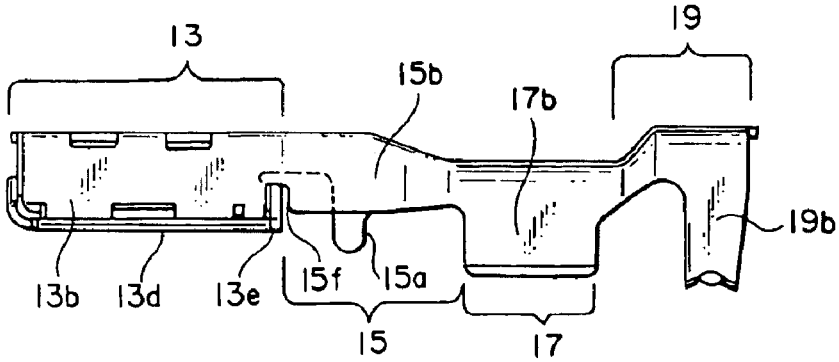
FIG. 3 is a rear view of the contact illustrated in FIG. 2.
Figure 4:
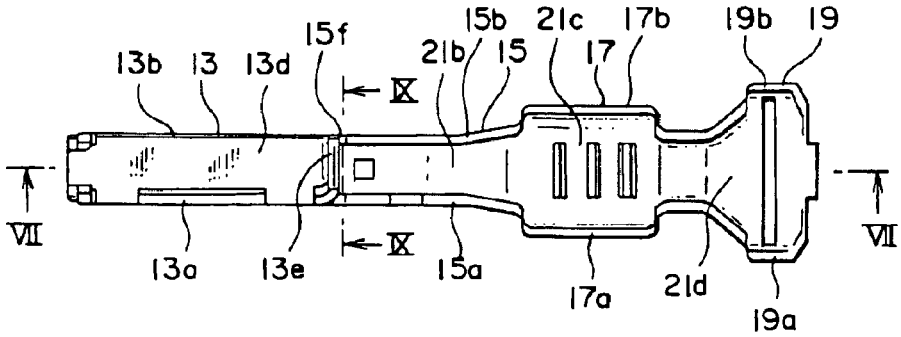
FIG. 4 is a plan view of the contact illustrated in FIG. 2.
Figure 5:
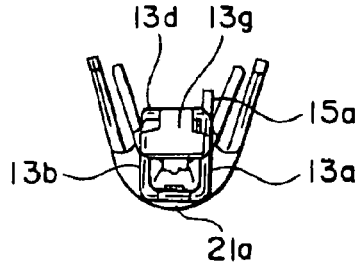
FIG. 5 is a left side view of the contact illustrated in FIG. 2 as seen from the left side.
Figure 6:
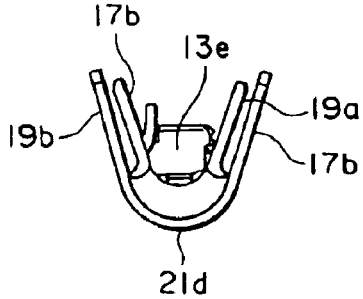
FIG. 6 is a right side view of the contact illustrated in FIG. 2 as seen from the right side.

The contact 11 may be produced from a strip-like thin conductive plate by a series of punching processes. Upon production, the contact 11 in the developed shape is subjected to a bending process in the state where the coupling portion 13 is connected to a first carrier 71 and the cable holding portion 19 is connected to a second carrier 73. Thus, the contact 11 illustrated in FIG. 2 is formed. After separating the contact 11 from the first and the second carriers 71 and 73, a core wire 51*a* of the cable 51 is placed on the press-fit bottom portion 21*c* of the press-fit portion 17 and an end portion of the cable 51 is placed on the holding bottom portion 21*d*. Thereafter, the first and the second press-fit wall portions 17*a* and 17*b* are subjected to a bending process so that the core wire 51*a* of the cable 51 is press fitted. By bending the first and the second holding wall portions 19*a* and 19*b*, the end portion of the cable 51 is held and secured.

Turning back to FIG. 1, each of the contacts 11 with the cable 51 and the core wire 51*a* connected thereto is inserted in the inserting direction depicted by an arrow A into each of a plurality of contact receiving portions 33 formed in the housing 31 illustrated in FIG. 1. On an upper wall surface of an intermediate portion of the contact receiving portion 33, a housing lance 35 is formed. The housing lance 35 is displaceable and has elasticity. The housing lance 35 has a base portion integrally connected to the upper wall surface and obliquely extends frontward in the inserting direction A and towards a space of the contact receiving portion 33.

In the state where the contact 11 is fitted to the contact receiving portion 33, the coupling bottom portion 13*a* of the coupling portion 13 is faced to a bottom wall surface of the contact receiving portion 33. The first and the second coupling wall portions 13*a* and 13*b* of the coupling portion 13 are faced to side wall surfaces of the contact receiving portion 33, respectively. The upper wall portion 13*d* of the coupling portion 13 is faced to the upper wall surface of the contact receiving portion 33.

When the contact 11 is inserted into the contact receiving portion 33, the housing lance 35 is bent because its end portion is pressed by the guide portion 13*g* of the contact 11. When the contact 11 is further inserted in the inserting direction A, a lance locking portion 35*a* of a protruding shape formed at an end portion of the housing lance 35 moves over the locking portion 13*e* of the contact 11 at a predetermined position of the contact receiving portion 33. Then, the lance locking portion 35*a* is slightly inserted between the first and the second coupling wall portions 15*a* and 15*b* of the coupling portion 15 so that the housing lance 35 is recovered into an original state. At this time, the lance locking portion 35*a* is faced to the locking portion 13*e* of the contact 11. The locking portion 13*e* faced to the housing lance 35 has a surface wider than the lance locking portion 35*a* of the housing lance 35.

Further, after the lance locking portion 35*a* is faced to the locking portion 13*e* of the contact 11, a key portion 41*a* of the key member 41 is inserted between the housing lance 35 and an internal wall surface so as to restrict swinging movement of the housing lance 35. Even if it is tried to remove the cable 51 in the removing direction B reverse to the inserting direction A, removal is normally impossible. Thus, the housing lance 35 and the key member 41 prevent the contact 11 from being removed out of the housing 31.

Figure 12:
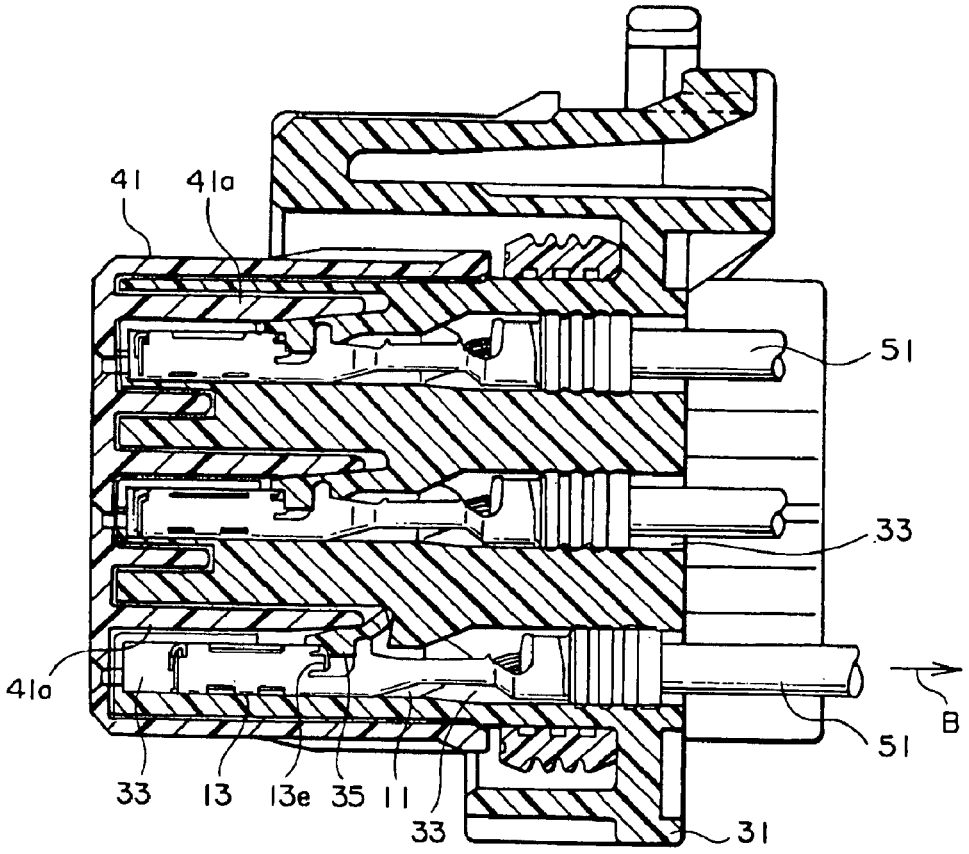
FIG. 12 is a sectional view of a housing lance in the connector illustrated in FIG. 1 in a broken state.
Figure 13:
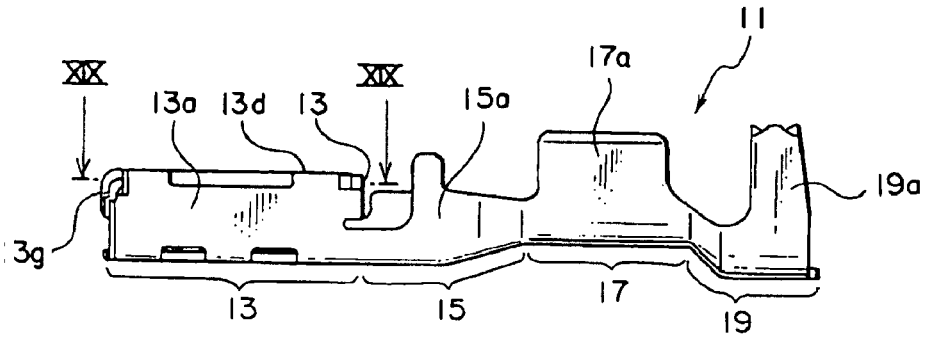
FIG. 13 is a side view of a contact of a connector according to a second embodiment of the present invention before a cable is connected thereto.
Figure 14:
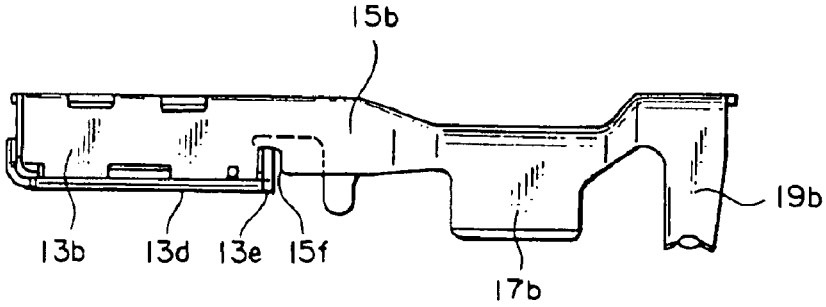
FIG. 14 is a rear view of the contact illustrated in FIG. 13.
Figure 15:
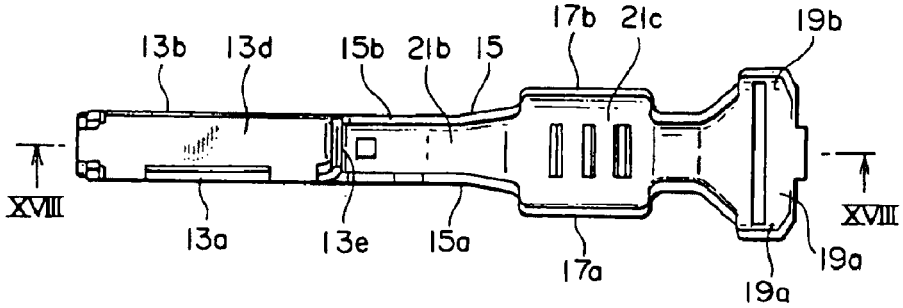
FIG. 15 is a plan view of the contact illustrated in FIG. 13.
Figure 16:
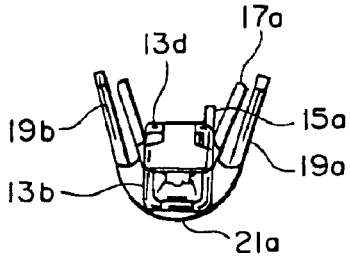
FIG. 16 is a left side view of the contact illustrated in FIG. 13 as seen from the left side.
Figure 17:
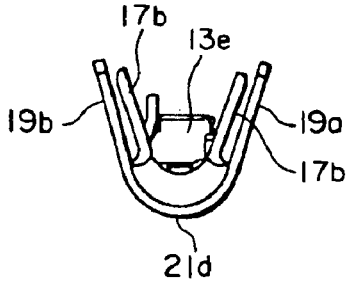
FIG. 17 is a right side view of the contact illustrated in FIG. 13 as seen from the right side.
Figure 18:
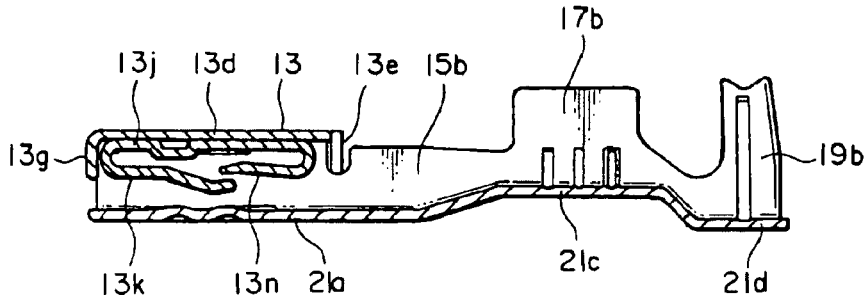
FIG. 18 is a sectional view taken along a line XVIII—XVIII in FIG. 15.
Figure 19:
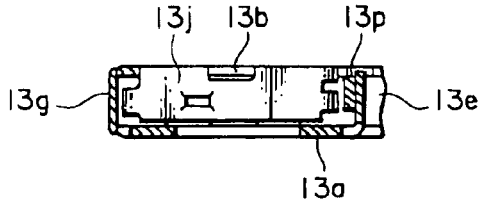
FIG. 19 is a sectional view taken along a line XIX—XIX in FIG. 13.
Figure 20:
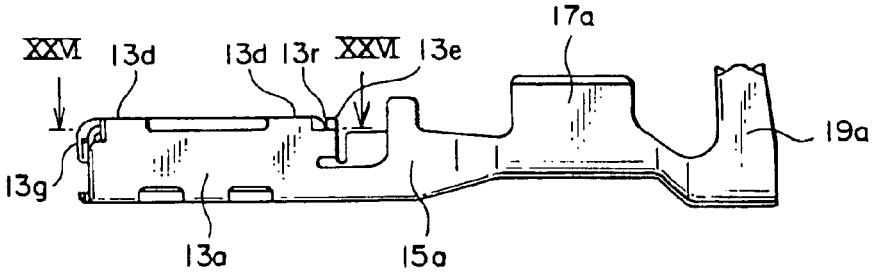
FIG. 20 is a front view of a contact of a connector according to a third embodiment of the present invention before a cable is connected thereto.
Figure 21:
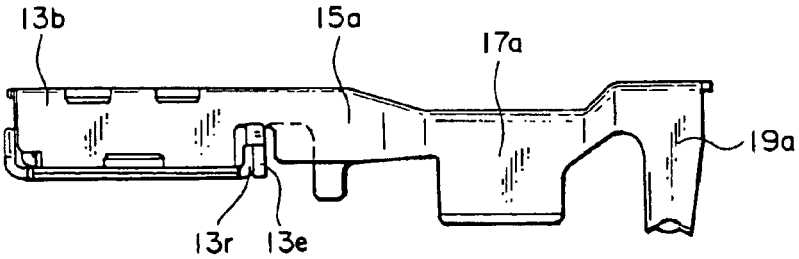
FIG. 21 is a rear view of the contact illustrated in FIG. 20.
Figure 22:
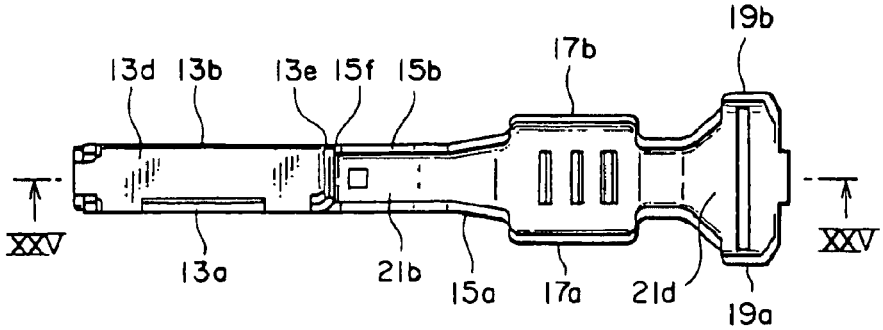
FIG. 22 is a plan view of the contact illustrated in FIG. 20.
Figure 23:
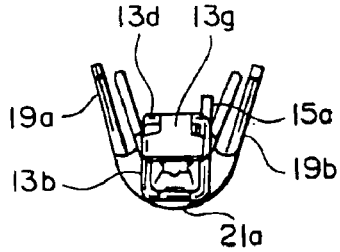
FIG. 23 is a left side view of the contact illustrated in FIG. 20 as seen from the left side.
Figure 24:
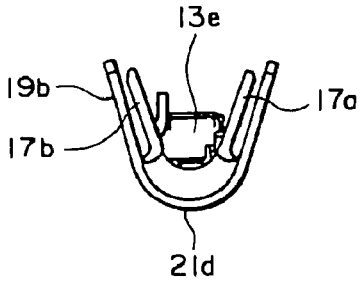
FIG. 24 is a right side view of the contact illustrated in FIG. 20 as seen from the right side.
Figure 25:
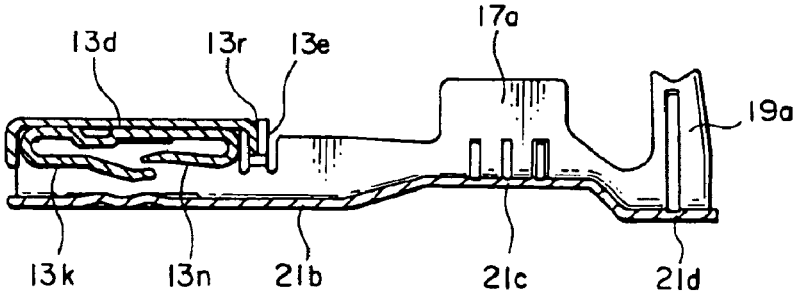
FIG. 25 is a sectional view taken along a line XXV—XXV in FIG. 22.
Figure 26:
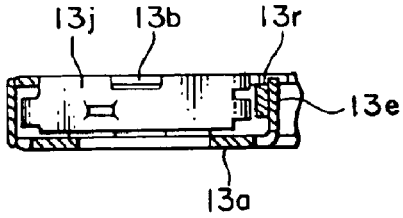
FIG. 26 is a sectional view taken along a line XXVI—XXVI in FIG. 20.

If large tensile force is applied in the removing direction B in the state where the connector is fixed as illustrated in FIG. 12, the contact 11 is moved in a direction of the tensile force within the contact receiving portion 33. Even if the locking portion 13*e* collides with the lance locking portion 35*a* of the housing lance 35 as a result of the above-mentioned movement, the load is concentrated to the base portion of the housing lance 35. Therefore, buckling of the housing lance 35 is prevented.

Referring to FIGS. 13 through 19, description will be made of a contact used in a connector according to a second embodiment of the present invention. Similar parts similar to those of the contact 11 described in conjunction with the first embodiment are designated by like reference numerals and will not be described any longer.

In the contact 11 illustrated in FIGS. 13 through 19, the coupling portion 13 has an auxiliary locking portion 13*p* formed on the side of the connecting portion 15. The auxiliary locking portion 13*p* is connected to the second coupling wall portion 13*b* and is generally perpendicularly bent so as to be brought into contact with the locking portion 13*e*. When the locking portion 13*e* collides with the lance locking portion 35*a* and is pressed and applied with a load, the auxiliary locking portion 13*p* serves to help the locking portion 13*e* to endure a heavy load.

Referring to FIGS. 20 through 26, description will be made of a contact of a connector according to a third embodiment of the present invention. Similar parts to those of the contact 11 described in conjunction with the first embodiment are designated by like reference numerals and will not be described any longer.

In the contact 11 illustrated in FIGS. 20 to 26, the coupling portion 13 has an auxiliary locking portion 13*r* formed on the side of the connecting portion 15. The auxiliary locking portion 13*r* is connected to the upper wall portion 13*d* and is generally perpendicularly bent so as to be brought into contact with the locking portion 13*e*. When the locking portion 13*e* collides with the lance locking portion 35*a* and is pressed and applied with a load, the auxiliary locking portion 13*r* serves to help the locking portion 13*e* to endure a heavy load.

Although the present invention has been shown and described in conjunction with the several preferred embodiments thereof, it will readily be understood by those skilled in the art that the present invention is not limited to the foregoing description but may be changed and modified in various other manners without departing from the spirit and scope of the present invention as set forth in the appended claims.

What is claimed is:

1. A connector comprising a housing and a contact held in the housing, wherein the housing comprises a displaceable housing lance, the contact comprising:

a contacting portion to be contacted with a connection object;

a wall portion surrounding the contacting portion; and a locking portion connected to the wall portion and adapted to be engaged with the housing lance, the wall portion having first and second side walls faced to each other with a space left therebetween, the locking portion extending from the first wide wall towards the second side wall and having an extending end, the second side wall having a locking/holding portion holding the extending ends wherein the housing comprises a contact receiving portion, the contact being inserted into the contact receiving portion in an inserting direction, the housing lance locking the contact in a removing direction reverse to the inserting direction, wherein the wall portion further comprises a bottom wall extending between the first and the second side walls, the contacting portion having a contacting piece located between the first and the second side walls, the contacting piece and the bottom wall being faced to each other with a space left therefrom to receive the connection object, wherein the contact comprises an auxiliary piece located between the first and the second side walls and faced to the bottom wall with a space left therefrom, the contacting piece having a free end located between the auxiliary piece and the bottom wall, and wherein the contacting piece extends from the wall portion in the removing direction, the auxiliary piece extending from the wall portion in the inserting direction.

2. The connector according to claim 1, wherein the wall portion comprises a top wall extending between the first and the second side walls and faced to the bottom wall with a space left therefrom, the contacting piece and the auxiliary piece being provided on the top wall.

3. The connector according to claim 1, wherein the locking/holding portion is a cut-out portion formed in the second side wall, the extending end being inserted into the cut-out portion.

4. The connector according to claim 1, wherein the contact comprises an auxiliary locking portion extending from the second side wall to be engaged with the locking portion in the removing direction.

5. The connector according to claim 1, wherein the wall portion comprises a top wall extending between the first and the second side walls, the contact having an auxiliary locking portion extending from the top wall to be engaged with the locking portion in the removing direction.

6. The connector according to claim 1, wherein the housing lance comprises elasticity so as to be engaged with and disengaged from the locking portion.

7. The connector according to claim 1, wherein the contact is connected to a cable and comprises:

a coupling portion to be coupled with the connection object;

a cable holding portion holding the cable;

a press-fit portion press-fitted to a core wire of the cable; and a connecting portion connecting the press-fit portion and the coupling portion to each other;

the contacting portion, the wall portion, and the locking portion being provided in the coupling portion.

8. A connector comprising a housing and a contact held in the housing, wherein the housing comprises a displaceable housing lance, the contact including:

a contacting portion to be contacted with a connection object;

a wall portion surrounding the contacting portion; and a locking portion connected to the wall portion and adapted to be engaged with the housing lance, the wall portion having first and second side walls faced to each other with a space left therebetween, the locking portion extending from the first wide wall towards the second side wall and having an extending end, the second side wall having a locking/holding portion holding the extending end, wherein the locking/holding portion is a cut-out portion formed in the second side wall, the extending end being inserted into the cut-out portion.

9. The connector according to claim 8, wherein the contact comprises an auxiliary locking portion extending from the second side wall to be engaged with the locking portion in the removing direction.

10. The connector according to claim 8, wherein the wall portion comprises a top wall extending between the first and the second side walls, the contact having an auxiliary locking portion extending from the top wall to be engaged with the locking portion in the removing direction.

11. The connector according to claim 8, wherein the housing lance comprises elasticity so as to be engaged with and disengaged from the locking portion.

12. The connector according to claim 8, wherein the contact is connected to a cable and comprises:

a coupling portion to be coupled with the connection object;

a cable holding portion holding the cable;

a press-fit portion press-fitted to a core wire of the cable; and a connecting portion connecting the press-fit portion and the coupling portion to each other, the contacting portion, the wall portion, and the locking portion being provided in the coupling portion.

13. The connector according to claim 8, wherein the housing comprises a contact receiving portion, the contact being inserted into the contact receiving portion in an inserting direction, the housing lance locking the contact in a removing direction reverse to the inserting direction.

14. The connector according to claim 13, wherein the wall portion further comprises a bottom wall extending between the first and the second side walls, the contacting portion having a contacting piece located between the first and the second side walls, the contacting piece and the bottom wall being faced to each other with a space left therefrom to receive the connection object.

15. The connector according to claim 14, wherein the contact comprises an auxiliary piece located between the first and the second side walls and faced to the bottom wall with a space left therefrom, the contacting piece having a free end located between the auxiliary piece and the bottom wall.

16. The connector according to claim 15, wherein the wall portion comprises a top wall extending between the first and the second side walls and faced to the bottom wall with a space left therefrom, the contacting piece and the auxiliary piece being provided on the top wall.

17. A connector comprising a housing and a contact held in the housing, wherein the housing comprises a displaceable housing lance, the contact including:

a contacting portion to be contacted with a connection object;

a wall portion surrounding the contacting portion; and a locking portion connected to the wall portion and adapted to be engaged with the housing lance, the wall portion having first and second side walls faced to each other with a space left therebetween, the locking portion extending from the first wide wall towards the second side wall and having an extending end, the second side wall having a locking/holding portion holding the extending end, wherein the contact comprises an auxiliary locking portion extending from the second side wall to be engaged with the locking portion in the removing direction.

18. The connector according to claim 17, wherein the housing lance comprises elasticity so as to be engaged with and disengaged from the locking portion.

19. The connector according to claim 17, wherein the contact is connected to a cable and comprises:

a coupling portion to be coupled with the connection object;

a cable holding portion holding the cable;

a press-fit portion press-fitted to a core wire of the cable; and a connecting portion connecting the press-fit portion and the coupling portion to each other, the contacting portion, the wall portion, and the locking portion being provided in the coupling portion.

20. The connector according to claim 17, wherein the housing comprises a contact receiving portion, the contact being inserted into the contact receiving portion in an inserting direction, the housing lance locking the contact in a removing direction reverse to the inserting direction.

21. The connector according to claim 20, wherein the wall portion further comprises a bottom wall extending between the first and the second side walls, the contacting portion having a contacting piece located between the first and the second side walls, the contacting piece and the bottom wall being faced to each other with a space left therefrom to receive the connection object.

22. The connector according to claim 21, wherein the contact comprises an auxiliary piece located between the first and the second side walls and faced to the bottom wall with a space left therefrom, the contacting piece having a free end located between the auxiliary piece and the bottom wall.

23. The connector according to claim 22, wherein the wall portion comprises a top wall extending between the first and the second side walls and faced to the bottom wall with a space left therefrom, the contacting piece and the auxiliary piece being provided on the top wall.

24. A connector comprising a housing and a contact held in the housing, wherein the housing comprises a displaceable housing lance, the contact including:

a contacting portion to be contacted with a connection object;

a wall portion surrounding the contacting portion; and a locking portion connected to the wall portion and adapted to be engaged with the housing lance, the wall portion having first and second side walls faced to each other with a space left therebetween, the locking portion extending from the first wide wall towards the second side wall and having an extending end, the second side wall having a locking/holding portion holding the extending end, wherein the wall portion comprises a top wall extending between the first and the second side walls, the contact having an auxiliary locking portion extending from the top wall to be engaged with the locking portion in the removing direction.

25. The connector according to claim 24, wherein the housing lance comprises elasticity so as to be engaged with and disengaged from the locking portion.

26. The connector according to claim 24, wherein the contact is connected to a cable and comprises:

a coupling portion to be coupled with the connection object;

a cable holding portion holding the cable;

a press-fit portion press-fitted to a core wire of the cable; and a connecting portion connecting the press-fit portion and the coupling portion to each other; the contacting portion, the wall portion, and the locking portion being provided in the coupling portion.

27. The connector according to claim 24, wherein the housing comprises a contact receiving portion, the contact being inserted into the contact receiving portion in an inserting direction, the housing lance locking the contact in a removing direction reverse to the inserting direction.

28. The connector according to claim 27, wherein the wall portion further comprises a bottom wall extending between the first and the second side walls, the contacting portion having a contacting piece located between the first and the second side walls, the contacting piece and the bottom wall being faced to each other with a space left therefrom to receive the connection object.

29. The connector according to claim 28, wherein the contact comprises an auxiliary piece located between the first and the second side walls and faced to the bottom wall with a space left therefrom, the contacting piece having a free end located between the auxiliary piece and the bottom wall.

30. The connector according to claim 29, wherein the wall portion comprises a top wall extending between the first and the second side walls and faced to the bottom wall with a space left therefrom, the contacting piece and the auxiliary piece being provided on the top wall.

* * * * *